US005804812A

United States Patent [19]

Wicke

[11] Patent Number: 5,804,812

[45] Date of Patent: Sep. 8, 1998

[54] MULTIPLE NODE LAMBERT GUIDANCE SYSTEM

[75] Inventor: Dallas C. Wicke, Garden Grove, Calif.

[73] Assignee: McDonnell Douglas Corporation, Huntington Beach, Calif.

[21] Appl. No.: 738,622

[22] Filed: Oct. 29, 1996

[51] Int. Cl.[6] ..... F41G 7/00; F41G 7/36

[52] U.S. Cl. ..... 244/3.1; 244/3.14; 244/3.2

[58] Field of Search ..... 244/3.1, 3.11, 244/3.14, 3.15, 3.2; 89/1.11; 342/62; 364/223.1

[56] References Cited

U.S. PATENT DOCUMENTS

| | | | |
|---|---|---|---|
| 3,758,052 | 9/1973 | McAlexander et al. | 244/3.14 |
| 4,387,865 | 6/1983 | Howard et al. | 244/3.1 |
| 5,071,087 | 12/1991 | Gray | 244/3.15 |
| 5,435,503 | 7/1995 | Johnson, Jr. et al. | 244/3.15 |
| 5,647,558 | 7/1997 | Linick | 244/3.11 |

OTHER PUBLICATIONS

John E. White, "Cut–Off Insensitive Guidance with Variable Time of Flight"; Technical Report, Sandia National Laboratories, Jan. 1993.

John E. White, "A Lambert Targeting Procedure for Rocket Systems that Lack Velocity Control"; Technical Report, Sandia National Laboratories, Nov. 1988.

Richard H. Battin, "Lambert's Problem Revisited"; AIAA Journal, vol. 15, No. 5, May 1977.

Jia Peiran and Tang Guojian, "Realization of Target Satellite Interception with Velocity–Gain Guidance"; Report, National Air Intelligence Center, Mar. 1996.

J.A. Lawton and C.A. Byrum, "Antitactical Ballistic Missile Global Effectiveness Model (AGEM) Intercept Algorithm"; Report, Naval Surface Warfare Center, Jul. 1994.

*Primary Examiner*—Charles T. Jordan
*Assistant Examiner*—Christopher K. Montgomery
*Attorney, Agent, or Firm*—Harness Dickey & Pierce P.L.C.

[57] ABSTRACT

A multi-node Lambert Guidance System that controls missile velocity along a missile flight path through adjustment of missile attitude during guidance of the missile through an intercept point and one or more way points. The system utilizes a linear Lambert solution in that it is derived from a plurality of Lambert solutions each corresponding to a particular node along the prelaunch flight path solution and each including corresponding time varying weights on the accuracy at several flight path nodes. The present invention allows direct translation of guidance velocity corrections into vehicle attitude adjustment commands, and thereby avoids additional computation required in prior predictive integration guidance approaches.

10 Claims, 4 Drawing Sheets

MULTIPLE NODE LAMBERT GUIDANCE SYSTEM

TECHNICAL FIELD

The present invention relates generally to ballistic missile defense systems, and more particularly, to a multi-node Lambert Guidance System for an interceptor missile that corrects missile velocity along the missile flight path by guiding the missile through the intercept point and one or more way points by adjusting missile attitude angle.

BACKGROUND OF THE INVENTION

Background Art

A launched interceptor missile typically includes guidance and control electronics that follows a set sequence of events. First, the missile is launched based on a prelaunch trajectory solution that satisfies a specified intercept point. Next, as the missile is guided through its boost, or ascent, phase, the system corrects for missile errors, navigation errors, atmospheric winds and other sources of error that tend to steer the missile off course. Also, as the missile advances along its flight path after boost phase termination, onboard missile navigation updates are downlinked to a ground based missile guidance segment to enable the ground based segment to communicate updates on predicted target position to the missile. Midcourse and terminal missile flight phase guidance corrections are also made prior to the missile reaching its intercept point.

Conventional missile guidance systems provide target point flight correction through additional correction capability, or impulsive velocity, to the missile payload to correct errors accumulated during the boost phase. Additionally, other conventional missile guidance systems correct for missile flight errors through position and/or velocity wire guidance communication to the missile flight control system. In another system approach, missile thrust termination between the first, second and third flight stages on the missile corrects missile flight errors. Other missile guidance control systems control the missile flight path through guidance energy management (GEM) maneuvers which involve an energy wasting maneuver, such as pitching the missile upwardly or downwardly or sending the missile through a corkscrew maneuver. However, such error correction techniques typically increase payload size due to the additional fuel and/or components required to perform the required function. Additionally, certain of the prior error correction techniques, such as the GEM maneuver, require the missile to have a large angle of attack. Therefore, when error correction is performed, large aerodynamic moments are created which in turn add stress to the control capability of the missile.

SUMMARY OF THE INVENTION

The present invention contemplates a multi-node Lambert Guidance System that controls missile velocity along a missile flight path through adjustment of missile attitude during guidance of the missile through an intercept point and one or more way points. The system utilizes a linear Lambert solution derived from a plurality of independent Lambert solutions, each corresponding to a particular node along the prelaunch flight path solution and each including corresponding time varying weights on the accuracy at several flight path nodes. The present invention allows direct translation of guidance velocity corrections into vehicle attitude adjustment commands, and thereby avoids additional computation required in prior predictive integration guidance approaches.

DETAILED DESCRIPTION OF THE PREFERRED EMBODIMENT

Figure 1:
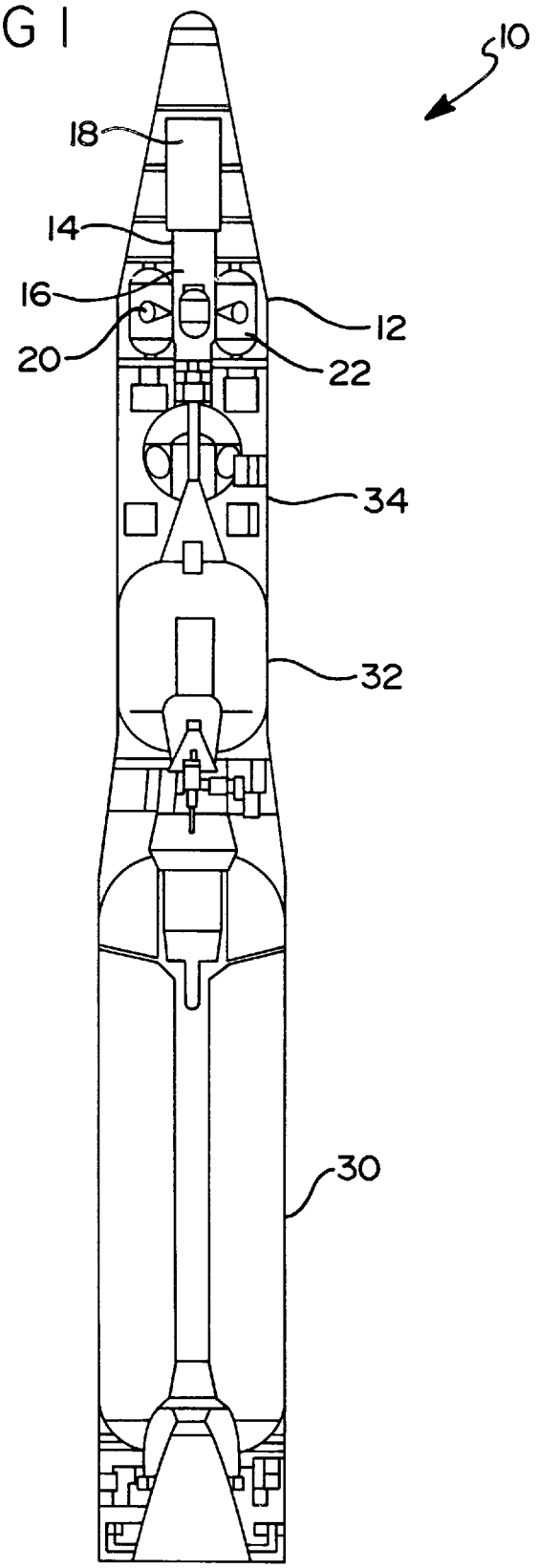
FIG. 1 illustrates a side elevational view, with a portion of its outer shell broken away, of a missile including an integrated boost phase missile guidance system according to the present invention.

Referring now to the drawings, FIG. 1 illustrates a missile 10 in which the preferred embodiment of the present invention may be utilized. The missile shown is typical of a strategic defense missile. However, the present invention may also be implemented in any strategic or tactical defense missiles, including surface to air, or conventional space launch vehicles for guidance and control purposes. For purposes of this description, the term "missile" will be used to refer in general to any launched vehicle capable of being guided by the multi-node Lambert Missile Guidance System of the present invention as described below.

Further referring to FIG. 1, the missile 10 includes a kill vehicle which constitutes the payload, shown generally at 12. The payload includes guidance control electronics 14 and onboard navigation electronics 16 of the type deployed in conventional strategic and tactical defense missiles. The payload also includes additional components, such as a sensor 18. Also located on the payload is a steering mechanism 20 which may be thrusters or other apparatus for adjusting the attitude or angle of attack of the missile in response to commands from the guidance control electronics 14 as will be described in detail below. The payload also includes a propulsion system 22 including fuel for propelling the kill vehicle to its intended target.

Modular booster stages 30, 32 and 34 are also operatively mounted to the payload 12. Each of the missile booster stages 30, 32 and 34 includes missile fuel and missile propulsion devices such as solid propellant rocket motors for separately propelling the missile along its planned trajectory at time-varying attitude angles to achieve missile velocity represented by the velocity vector V and flight path angle $\gamma$, in three stages, as is well known in the art and as will be described in more detail below. Each booster stage includes control devices such as thrust vector control or reaction type attitude control systems and/or aerodynamic control devices which respond to the guidance and control electronics located in the payload section.

Figure 2:
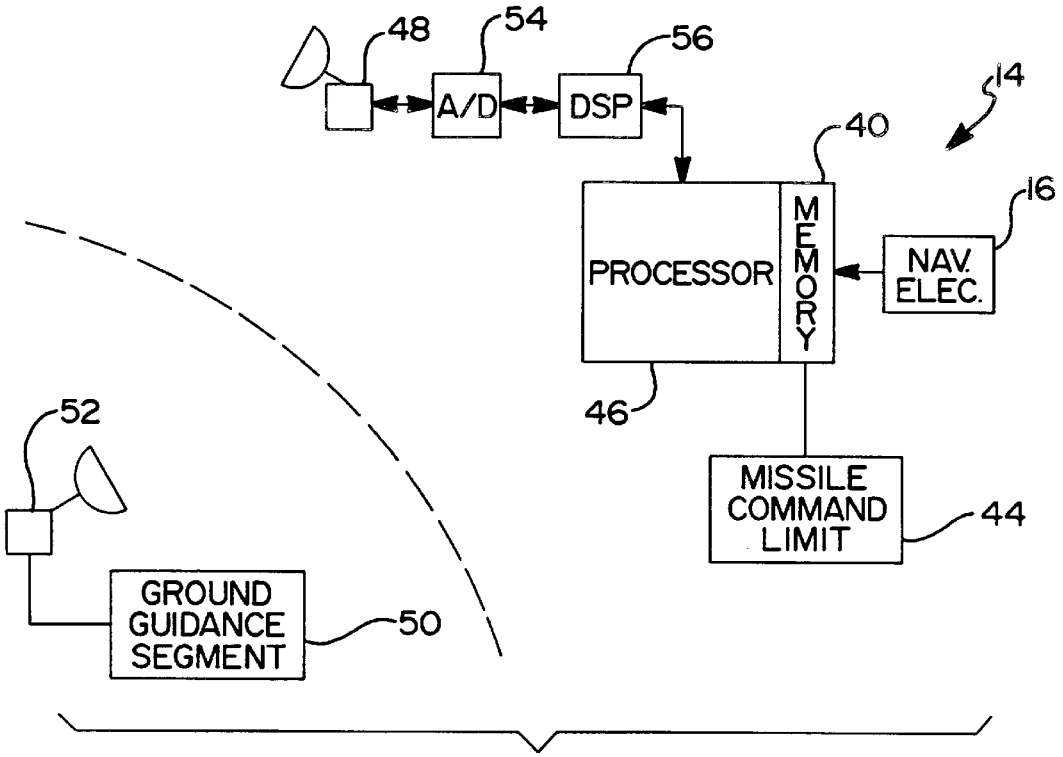
FIG. 2 is a block diagram of the integrated boost phase missile guidance system of the present invention.

Referring to FIG. 2, the diagram of the guidance control electronics 14 is shown. The guidance control electronics includes a memory 40 programmed with the multi-node Lambert Missile Guidance System logic according to the present invention and a processor 46 for executing this logic stored in the memory 40. In particular, the memory 40 and the processor 46 implement the system 44 of the present invention discussed below in detail. An antenna 48 of the type RF is operatively connected to the processor 46 for providing a link between the onboard guidance control electronics 14 and a ground based control system 50, through a ground based antenna 52. The antenna receives analog signals from the ground based antenna 52 which are converted to digital signals through an analog to digital converter 54 and processed through a digital signal processor 56 before being input into the processor 46, as is conventional in the art.

Figure 3:
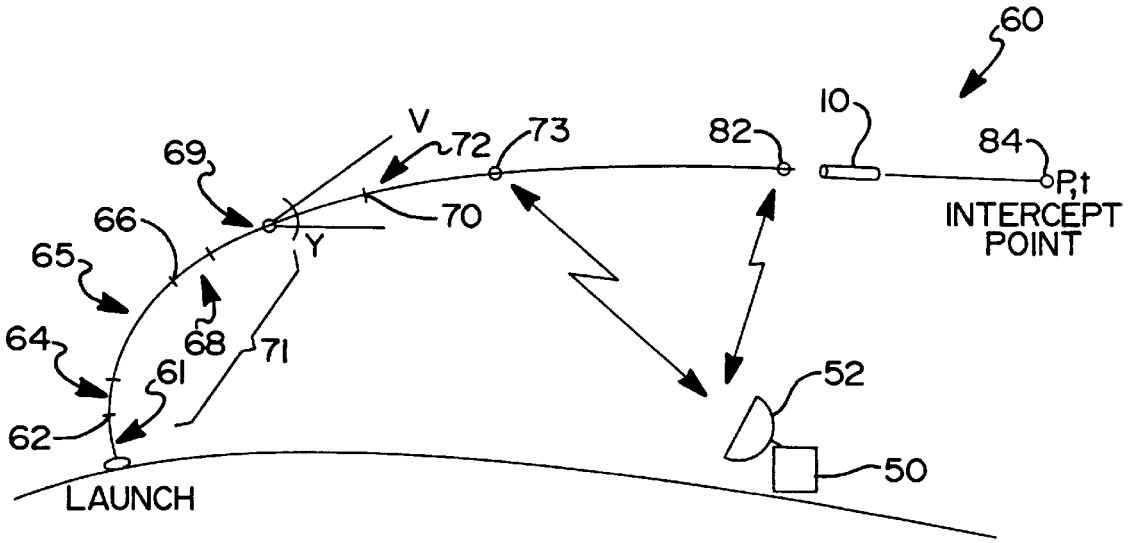
FIG. 3 is a schematic view illustrating the flight path of the missile of FIG. 1.

Referring to FIG. 3, a diagram indicating the various stages of flight of the missile 10 is shown generally at 60 and will now be generally described. Initially, as the missile is launched, the first booster stage 30 is ignited and propels the missile through a burn stage 61 until it reaches a burnout stage 62. Subsequently, the missile enters a coast stage 64 until the second booster stage 32 is ignited. The second booster stage 32 subsequently propels the missile through a burn stage 65 until it reaches a burnout stage 66, at which time the missile enters a second coast stage 68. The missile subsequently remains in the coast stage 68 until the third booster stage 34 is ignited. The third booster stage 34 then propels the missile through a third burn stage 69 until it reaches a burnout stage 70. The combination of the three booster stages will be referred to as the missile boost phase 71. Subsequently, the missile enters a third coast stage 72 until the payload passes through a first node 73, at which time the missile guidance and navigational electronics 14, 16 communicate with a ground based guidance segment 50 through the directional antenna 52 via downlink 80. As will be explained in more detail below, the ground based guidance segment 50 subsequently provides an uplink through the directional antenna 52 to the missile at an inflight target update (IFTU) point 82 to provide final target tracking information to the missile to adjust its intended intercept point 84.

Still referring to FIG. 3, the multi-node Lambert Missile Guidance System of the present invention guides the missile 10 preferably during the burn of the third booster stage 34. The system of the present invention is programmed into the memory 40 via FORTRAN programming language, or any other software programming language well known to those skilled in the art, and ensures correct arrival time of the missile at the flight path point 73 and at the intercept point 84, as will now be explained in detail.

The Lambert guidance system 44 is programmed to compute independent Lambert guidance solutions for guidance nodes, such as the way point 73 shown in FIG. 3, which represent a particular time and position point for the missile on its flight path trajectory. The computed solutions satisfy the basic Lambert approach:

A velocity correction, when added vectorially to the current velocity shall cause the missile in free flight to pass through a specified position at a specified time. The mathematical solution of the single-point Lambert problem is well documented in the literature of guidance and control and orbital mechanics.

The basic approach of the present invention is to form independent Lambert guidance solutions for each guidance node to be satisfied and combine the solutions for the resulting guidance corrections in accordance with time-varying weights. The combination of solutions may be expressed in the mathematical form as follows:

$$G = \sum_{i=1}^{n} a_i G_i$$

where

G=guidance correction;

$a_i$=guidance weighting factor for node i;

$G_i$=Lambert guidance correction for node i; and n=number of guidance nodes to be satisfied.

Further, the weighting factors shall satisfy the following constraint equation so that the linear solution will be bounded and stable for any selection of the parameter n.

$$\sum_{i=1}^{n} a_i = 1.$$

The preferred approach employs a particular form of the above in which independent solutions are satisfied on the missile flight path for two points: The intercept point 84 and the intermediate way point 73 at which a communication downlink is contemplated. Thus, two Lambert solutions, each of which independently satisfy two desired points of accuracy on the missile flight path, are formed and then combined to produce appropriate missile guidance corrections. This is accomplished by applying time varying weights to each independent solution. The linear combination of independent Lambert solutions for the above two points is as follows:

$$G = a\,G_I + (1-a)G_{HC}$$

where

G=guidance correction;

$G_I$=guidance correction to satisfy intercept position and time (e.g., Lambert Δv);

$G_{HC}$=guidance correction to satisfy position and time at planned downlink communication point; and a=guidance transition factor.

The guidance transition factor "a" is defined as follows:

| | |
|---|---|
| $a = 0$ | $(t \leq t_G)$ |
| $a = (t-t_G)/(t_{T-tG})$ | $(t_G < t < t_T)$ |
| $a = 1$ | $(t \geq t_T)$ |
| t =time from interceptor Iaunch; | |
| $t_G$ =time of Lambert guidance start; and | |
| $t_T$ =time of guidance law transition completion. | |

Figure 4:
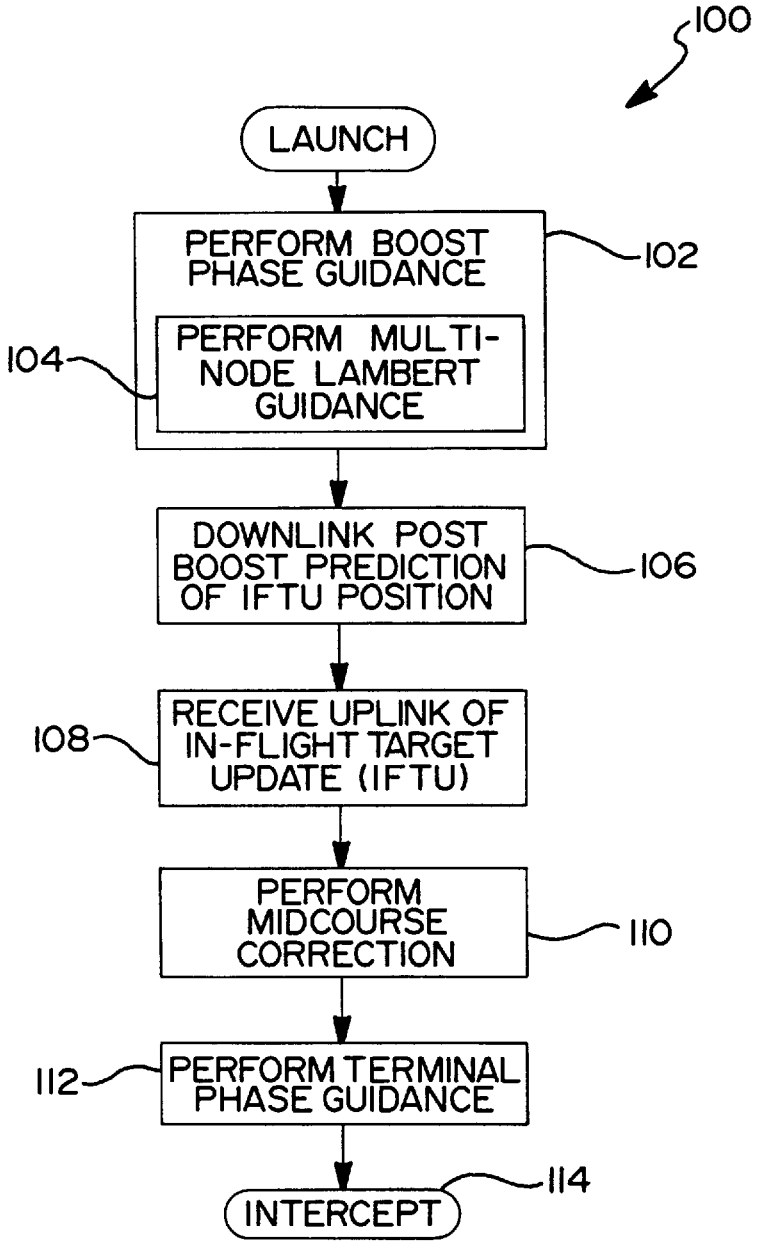
FIG. 4 is a flow diagram illustrating the methodology of the present invention incorporated into the overall missile guidance system.

Referring to FIG. 4, in operation, onboard navigation electronics 16, which are typically aided by a Global Positioning Satellite System or other wireless guidance systems, inputs missile flight path position data into the Lambert guidance sub-system 44 at a rate that allows the sub-system to cycle through the linear combination of Lambert guidance solutions approximately 20 to 60 times per second. The guidance correction solution output from the sub-system is output to the missile guidance electronics which inputs the Lambert solutions into missile guidance equations. Outputs from the missile guidance equations are used to adjust missile attitude.

The Lambert guidance sub-system generates independent Lambert solutions, the first of which satisfies pre-launch flight conditions at a first way point, indicated at 73 in FIG. 3. This way point serves as a communication downlink point to the ground based guidance control segment 50 via the directional antenna 52. Thus, missile flight information may be downlinked to the ground based guidance segment through the directional antenna to insure accurate pointing of the ground based antenna on subsequent uplink transmissions. The downlinked missile navigation data is processed by the ground based guidance segment, which in turn provides a subsequent inflight target update (IFTU) uplink communication to the missile at point 82 in the missile flight path.

The downlink-uplink approach eliminates the necessity for the missile guidance control electronics to guide the missile through the predetermined IFTU point. The downlinked navigation data is used to predict the actual IFTU position of the missile so that the directional antenna may be adjusted accordingly for an uplink transmission to provide the guidance control electronics with updated target information at the IFTU point 82. This prediction is preferably made shortly after burnout of the third booster stage 34 and is based on missile navigation during the coast stage subsequent to the burnout of the third booster stage 34, taking into account post-boost guidance correction, as discussed in more detail below. Thus, while the Lambert guidance system 44 receives updated flight information almost on a continuous basis for cycling through the independent solutions, target information is updated preferably only once at the IFTU 82.

Referring to FIG. 4, the methodology of the multi-node Lambert Missile Guidance System of the present invention is shown in conjunction with an overall missile guidance system at 100. At step 102, the guidance system performs guidance functions during the boost phase of the missile. It is during the boost phase guidance of the missile that the multi-node Lambert Guidance System of the present invention operates to correct missile velocity errors occurring during this stage of the missile flight, as indicated in substep 104. After the linear combination of weighted Lambert guidance solutions are calculated at sub-step 104 and missile attitude angles adjusted accordingly, the missile is guided through the first way point 73. The missile is guided through this first way point 73 according to a prelaunch solution programmed into the memory 40 to ensure that a downlink is achieved with the ground based directional antenna 52 pointed to the prelaunch plan position at way point 73. Thus, at step 106, missile navigation data is downlinked to the ground based guidance segment 50 to enable calculation of the post boost prediction of missile position at an inflight target update position 82. As a result, the directional antenna 52 is adjusted to the calculated IFTU position. At step 108 the ground based guidance segment 50, through the adjusted directional antenna 52, uplinks the updated target track data to the missile at the IFTU point 82. Thus, although missile flight path direction data is adjusted anywhere from 20 to 60 times per second, the target intercept point information need only be updated once at the IFTU point. Subsequently, the missile guidance system performs midcourse correction of the missile flight at step 110 and terminal phase guidance at step 112, both of which are beyond the scope of the present invention. Subsequently at step 114, the missile reaches the intercept point 84.

Figure 5:
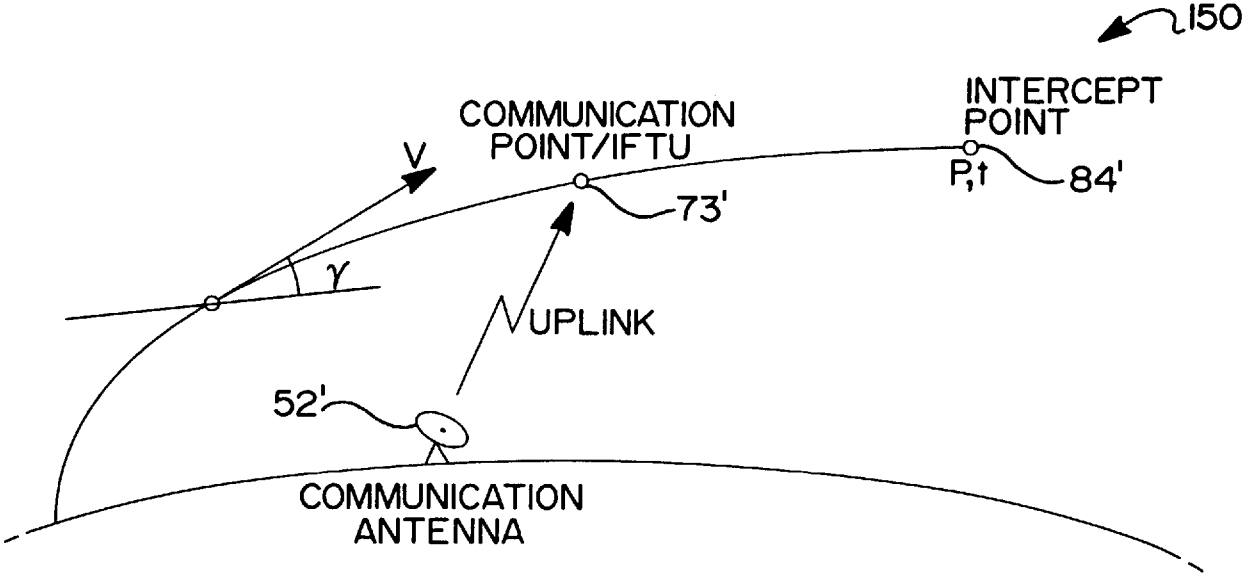
FIG. 5 illustrates the system performing missile guidance for a missile having a short flight path.

Referring to FIG. 5, operation of the multi-node Lambert Missile Guidance System of the present invention, in conjunction with a missile having a short time of flight, is shown generally at 150. The operation of the Lambert Guidance System of the present invention relative to a short flight path still provides guidance through correction of the velocity of vector V and the missile flight path angle $\gamma$ to enforce missile position in time at the way point and at the intercept point. However, because the missile flight path is relatively short, such as between 100 and 1000 kilometers for a strategic defense type missile, the system requires only an uplink at way point 73' to update the missile guidance control electronics to provide updated intercept information to the missile at the IFTU point 84. No downlink from the missile to the ground based guidance system is required, due to the smaller possible deviation from the flight path of the missile on the shorter intercept course.

As should be understood upon reading the foregoing description, the Lambert Guidance System of the present invention provides a linear, weighted solution to multiple prelaunch missile flight path Lambert solutions. The Lambert Guidance System of the present invention guides the missile through a prelaunch determined flight path point to ensure the downlink with a directional antenna of a ground based guidance update system, and thus a subsequent uplink between the ground based system and the missile at an inflight target update point determined by the ground based system from the downlinked missile flight information. Therefore, the intercept point need only be updated once, rather than multiple times along the missile flight path as with prior missile guidance systems. The Lambert Guidance System of the present invention corrects missile velocity continuously during flight of the missile in response to missile navigation data through adjustment of the missile attitude angle to also ensure the accuracy of the missile in reaching its intercept point.

While the above detailed description describes the preferred embodiment of the present invention, the invention is susceptible to modification, variation and alteration without deviating from the scope and fair meaning of the subjoined claims.

What is claimed is:

1. A method for guiding a missile to an intercept point, comprising the steps of:

providing onboard missile guidance electronics having a processor and a memory;

programming the memory with a plurality of independent Lambert guidance solutions, each being associated with a node on a missile flight path;

assigning a time varying weighting factor to each of said independent Lambert guidance solutions;

combining said independent Lambert guidance solutions into a linear combination solution to determine necessary missile guidance correction parameters; and outputting data from said linear combination solution to adjust missile attitude and thereby missile velocity for correct timing and positioning of said missile.

2. The method of claim 1 further comprising the steps of:

providing missile navigation data to a ground based guidance system via a communication link;

predicting position and timing of an inflight target update point; and adjusting said communication link to communicate revised intercept point data to said missile at said inflight target update point.

3. The method of claim 1, wherein said step of combining said independent Lambert guidance solutions into a linear combination solution comprises the step of combining said independent Lambert guidance solutions through the following equation:

$$G=a\,G_I+(1-a)G_{HC}$$

where

G=guidance correction;

$G_I$=guidance correction to satisfy intercept position and time (e.g., Lambert $\Delta v$);

$G_{HC}$=guidance correction to satisfy position and time at planned downlink communication point; and a=guidance transition factor.

4. The method of claim 3, further comprising the step of defining the guidance transition factor a through the following parameters:

| | |
|---|---|
| $a = 0$ | $(t \leqq t_G)$ |
| $a = (t-t_G)/(t-t_G)$ | $(t_G < t < t_T)$ |
| $a = 1$ | $(t > t_T)$ |

where $t$ = time from interceptor launch;

$t_G$ = time of Lambert guidance start (shortly after third stage ignition for three-stage missile); and $t_T$ = time of guidance law transition completion where t=time from interceptor launch;

$t_G$=time of Lambert guidance start (shortly after third stage ignition for three-stage missile); and $t_T$=time of guidance law transition completion.

5. A multi-node Lambert Guidance System for a missile, comprising:

navigation means for generating missile coordinate data;

a memory programmed with a plurality of prelaunch Lambert solutions for a plurality of nodes along a missile prelaunch solution flight path;

a processor for determining a solution for a weighted linear combination of said Lambert solutions for correction of missile flight path errors based on data input from said navigation means; and steering means for correcting said missile flight path errors in response to flight path error correction commands output from said processor.

6. The system of claim 5 wherein said weighted linear combination of independent Lambert solutions is computed through the following equation:

$$G=a\ G_I+(1-a)G_{HC}$$

where

G=guidance correction, $G_I$=guidance correction to satisfy intercept position and time (e.g., Lambert Δv);

$G_{HC}$=guidance correction to satisfy position and time at planned downlink communication point; and a=guidance transition factor.

7. The system of claim 6, wherein said guidance transition factor a is calculated with the following parameters:

| | |
|---|---|
| $a = 0$ | $(t \leqq t_G)$ |
| $a = (t-t_G)/(t-t_G)$ | $(t_G < t < t_T)$ |
| $a = 1$ | $(t \geqq t_T)$; |

where $t$ = time from interceptor launch;

$t_G$ = time of Lambert guidance start (shortly after third stage ignition for three-stage missile) and $t_T$ = time of guidance law transition completion.

8. The system of claim 5 further comprising a ground based guidance system having a directional antenna, said directional antenna providing a communication link between said missile and said ground based guidance system coincident with at least one missile flight path way point for receiving missile navigation data, and a communication link at an intermediate flight transmission update (IFTU) point for sending updated intercept point information to said missile at said IFTU point calculated by said ground based guidance system and based on said missile navigation data.

9. The system of claim 5, wherein said steering means adjusts missile attitude to correct missile velocity errors.

10. The method of claim 1, wherein said step of combining said independent Lambert guidance solutions into a linear solution comprises the step of combining said independent Lambert guidance solutions through the following equation:

$$G = \sum_{i=1}^{n} a_i G_i$$

where:

G=guidance correction;

$a_i$=guidance weighting factor for node i;

$G_i$=Lambert guidance correction for node i;

n=number of guidance nodes to be satisfied; and wherein, the weighting factors satisfy the following constraint equation:

$$\sum_{i=1}^{n} a_i = 1.$$

* * * * *

UNITED STATES PATENT AND TRADEMARK OFFICE

CERTIFICATE OF CORRECTION

PATENT NO. : 5,804,812
DATED : September 8, 1998
INVENTOR(S) : Dallas C. Wicke

It is certified that error appears in the above-identified patent and that said Letters Patent is hereby corrected as shown below:

Title page, item [56], under "OTHER PUBLICATIONS", insert
"Guidance And Targeting For The Strategic Target System" by John E. White; Technical Report, Sandia National Laboratories, 1990.

Column 3, Line 54, ":" should be --.--.

Column 4, Line 13, "." should be --:--.

Column 4, Line 45, "Iaunch" should be -- launch --.

Column 7, Line 15, "Iaw" should be --law--.

UNITED STATES PATENT AND TRADEMARK OFFICE

CERTIFICATE OF CORRECTION

PATENT NO. : 5,804,812
DATED : September 8, 1998
INVENTOR(S) : Dallas C. Wicke

It is certified that error appears in the above-identified patent and that said Letters Patent is hereby corrected as shown below:

Column 7, Line 18, the following text was duplicated:

"where t=time from interceptor launch;

$t_G$=time of Lambert guidance start (shortly after third stage ignition for three-stage missile); and $t_T$=time of guidance law transition completion."

Signed and Sealed this

Twenty-seventh Day of April, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO : 5,804,812

DATED : September 8, 1998

INVENTOR : Dallas C. Wicke

It is certified that error appears in the above-identified patent and that said Letters Patent is hereby corrected as shown below:

ON THE TITLE PAGE insert the following statement after the title:

"This invention was made with Government support under contract DASG60-90-C-0166 awarded by the U.S. Army. The Government has certain rights in this invention"

Signed and Sealed this

Ninth Day of May, 2000

*Attest:*

Q. TODD DICKINSON

*Attesting Officer*

*Director of Patents and Trademarks*